United States Patent [19]

Dolinsek

[11] 4,178,030

[45] Dec. 11, 1979

[54] GRAPPLE OR GRAB-BUCKET SAFETY MECHANISM

[75] Inventor: Hans Dolinsek, Stuttgart, Fed. Rep. of Germany

[73] Assignee: Firma Johannes Fuchs, Ditzingen, Fed. Rep. of Germany

[21] Appl. No.: 898,324

[22] Filed: Apr. 20, 1978

[30] Foreign Application Priority Data

Apr. 26, 1977 [DE] Fed. Rep. of Germany ..... 2718434

[51] Int. Cl.[2] ..... B66C 3/16

[52] U.S. Cl. ..... 294/70; 37/187; 294/88

[58] Field of Search ..... 294/70, 71, 86 R, 88, 294/106, 107; 37/183 R–188; 267/137; 214/147 G, 656, 658

[56] References Cited

U.S. PATENT DOCUMENTS

| | | | |
|---|---|---|---|
| 1,055,425 | 3/1913 | Smith | 37/184 |
| 1,096,214 | 5/1914 | Andersen | 37/184 |
| 1,153,950 | 9/1915 | Peterson | 37/185 |
| 1,231,779 | 7/1917 | Norris | 37/186 |
| 2,877,575 | 3/1959 | Stedt | 294/88 X |
| 3,194,329 | 7/1965 | Wallers | 294/88 X |

FOREIGN PATENT DOCUMENTS

| | | | |
|---|---|---|---|
| 1325723 | 3/1963 | France | 294/88 |

*Primary Examiner*—Johnny D. Cherry
*Attorney, Agent, or Firm*—Hopgood, Calimafde, Kalil, Blaustein & Lieberman

[57] ABSTRACT

The invention contemplates an improved grapple or grab-bucket construction of the double-acting hydraulically activated variety, wherein the normal bucket-open position is determined by a stiffly yieldable abutment which yields to permit a short further energy-absorbing bucket-opening displacement in the presence of the mechanical shock encountered upon dropping the open grab bucket onto a relatively hard base to be excavated. The short further shock-induced displacement elevates hydraulic pressure in the actuation system, which elevated pressure is vented by a relief valve in common with the hydraulic actuators of all buckets in the grapple.

4 Claims, 2 Drawing Figures

GRAPPLE OR GRAB-BUCKET SAFETY MECHANISM

The invention relates to a working machine, e.g. crane, excavator and the like, with working attachments, such as a grapple, each said attachment having a grab with at least two buckets which can be operated by at least one hydraulic cylinder and whose open position is limited by buffer-spring means.

It is the object of the invention to provide an improved construction with features to prolong the service life of such a working machine.

Applicant has realized that the service life of known working machines of the above-mentioned kind is greatly limited by the fact that the buffer springs are compressed up to their stops by the hydraulic pressure during opening of a grab. This has the result that, when the opened grab strikes a foundation, the resulting impact is transmitted directly to the working attachments, whereby these are put under great stress.

The above-mentioned object is achieved in a working machine of the previously-mentioned kind according to the invention by combination of following features:

(a) that the buffer springs are so proportioned that they can be compressed only over a part of their total stroke by the hydraulic pressure keeping the buckets in their open position;

(b) that the pressure chamber of the hydraulic cylinder which is under operating pressure during the closing movement of the grab buckets is connected to the pressure means return flow by a safety valve or pressure relief valve.

By the combined application of both of the above-mentioned features (a) and (b), it is achieved that the buffer springs as well as the hydraulic cylinders in the open position of the grab buckets enable a further movement of the grab buckets into the opening position since, if the opened grab strikes a foundation the buffer springs can be compressed even further and the safety valve can thereby open. by compressing the buffer springs and by opening the safety valve, a great part of the impact force is spent so that the working attachment is not under such great stress as before, this leading to a significantly longer service life.

When there are several hydraulic cylinders for several grab buckets, a common safety valve can be provided, in an advantageous embodiment. In such a case, if the grab touches the foundation with only one bucket, then, through the movement of this one bucket caused by the impact, the pressure fluid is forced from the pressure chamber, said pressure chamber being under operating pressure during the closing movement of this grab bucket, into the corresponding pressure chambers of one or more other grab buckets, so that these move in the closing direction and also strike the foundation. Thus, also the impact force caused by the impact is destroyed.

Figure 1:
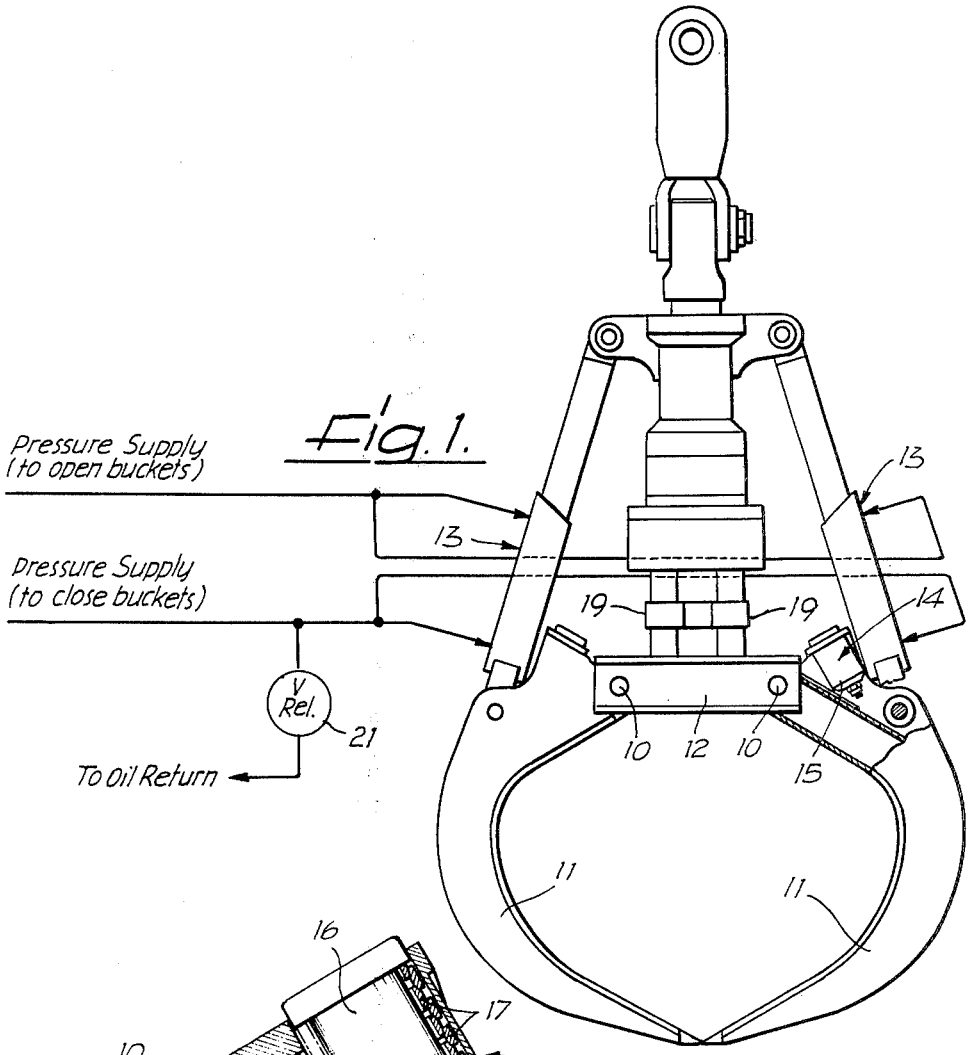
Figure 2:
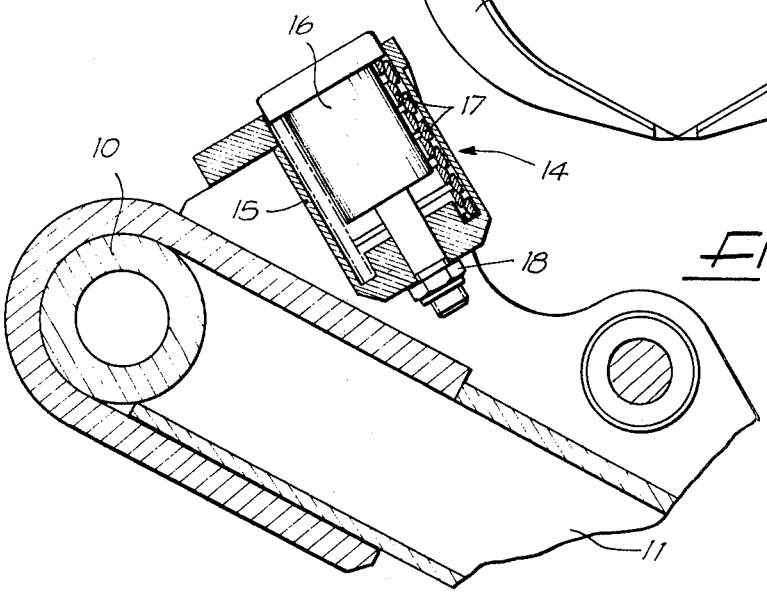

The invention is explained in detail in the following description of an embodiment:

FIG. 1 is a side view of a grab with two buckets, in the closed state, the buffer-spring region of one of the buckets being broken away and insection; and FIG. 2 is an enlarged fragmentary sectional view through the broken-away buffer-spring region of FIG. 1.

Although the effect of the preventive measure in accordance with the invention extends to the service life of the whole working machine, e.g. crane, excavator and the like, and in particular to the service life of its working attachments, this effect according to the invention is achieved only by a preventive measure directly on the grab itself. For this reason, the working machine, e.g. crane, excavator and the like, and the working attachments are not shown in the accompanying drawing because these are executed in the known way also in the working machine in accordance with the invention.

In the grab with two buckets 11 shown in the drawing, both buckets are pivotally connected on axes 10 to a bucket carrier 12. To pivot the buckets 11, a hydraulic cylinder 13 grasps each bucket via a pinned connection, and each said hydraulic cylinder has a double-acting piston. To limit the open position, a buffer spring 14 in the form of an annular spring is provided on each grab bucket 11, said annular spring being contained in the annular space between a spring shell 15 and a spring piston 16. Piston 16 includes an enlarged abutment head which normally projects beyond shell 15 and which sustains preloaded compression force of spring 14, as adjusted by an externally accessible nut 18 connection to the reduced tail or rod end of piston 16. As shown, spring 14 comprises a spring bundle made up of overlapping frictionally engaging spring rings 17, retained within shell 15.

On the bucket carrier 12, a stop 19 is provided for the piston 16 of each buffer spring 14. The free end of the piston of each hydraulic cylinder 13 is also pivotably fastened to the bucket carrier 12.

The preloaded resilience of the buffer spring 14 formed by the bundle of spring rings 17 is so selected that, in the normal application of hydraulic pressure to cylinders 13 in the direction to keep the grab buckets 11 in their open positions, such hydraulic pressure can press the spring piston 16 only over a part of its total stroke into the spring shell 15; thus, in the open position of the grab, its buckets 11 can be moved beyond their normal, hydraulically actuated, open position in the opening direction and against the force of the buffer springs 14.

So that this movement is not impaired by the hydraulic cylinders, the pressure chambers of the hydraulic cylinders 13, said pressure chambers being under operating pressure during the closing movement of the grab buckets, are connected to the oil return flow by a common pressure-relief or safety valve 21, as suggested schematically in the drawing.

It is achieved by the invention that, if the grab strikes a foundation with all its grab buckets simultaneously, the grab buckets are swung further in the opening direction and against the force of the buffer springs 14, so that the pressure in the pressure chamber of the hydraulic cylinder rises and the safety valve opens. By adjusting the buffer spring 14 to work with great friction and in conjunction with the safety valve, much of the impact force is spent, so that stress and mechanical shock on the working attachments of the working machine are thus reduced to a minimum, thereby leading to a significant prolongation of the service life of the working machine.

However, if the grab touches the foundation with only one bucket, then, during the control of the force of the buffer spring 14, pressure fluid is forced out of the appertaining hydraulic cylinder into the corresponding pressure chamber of the other hydraulic cylinder 13, so that the other grab bucket is driven in the closing direction and thereby also strikes the foundation. In case the impact force has not yet been spent, both grab buckets are then moved together a little in the opening direction of movement, in which event the mechanical shock is relieved by the shared action of both springs 14.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. Working machine, e.g. crane, excavator and the like, with a working attachment which has a grab with at least two buckets, which can be operated by at least one double-acting hydraulic cylinder having a first hydraulic-pressure connection for bucket-opening operation and a second hydraulic-pressure connection for bucket-closing operation, and whose open position is limited by buffer springs, characterized by the combination of features:

(a) that the buffer springs are so proportioned that they can be compressed only over a part of their stroke by the hydraulic pressure keeping the buckets in their open position, and (b) that the second hydraulic-pressure connection includes a safety valve or pressure relief valve for venting such excess pressure in the second hydraulic-pressure connection as in occasioned by a bucket-opening cylinder displacement giving rise to buffer-spring compression beyond said stroke part.

2. Working machine, e.g. crane, excavator and the like, in accordance with claim 1, characterized in that a common safety valve is provided when there are several hydraulic cylinders for several grab buckets

3. Working machine, e.g. crane, excavator and the like, in accordance with claim 1 or 2, characterized in that an annular spring is provided as a buffer spring.

4. In a grapple or the like excavating device for use as a working attachment for a crane, excavator or the like, said grapple comprising at least two pivoted buckets with at least one selectively operable double-acting hydraulic cylinder for bucket actuation from open to closed position and from closed to open position, the normal bucket-open position being limited by energy-absorbing buffer means, the improvement in which said buffer means includes a yieldably displaceable abutment having an energy-absorbing stroke of such extent that only a portion of said stroke is used in arresting bucket-opening movement in the presence of a bucket-opening actuation by said cylinder, whereby a portion of said stroke remains in which to absorb such mechanical shock in the bucket-opening direction as may be encountered by a bucket while in its normal bucket-open position, and pressure-relief valve means connected to that end of said cylinder which receives pressure fluid for actuation in the bucket-closing direction.

* * * * *